US010325455B2

(12) United States Patent
Movsisyan

(10) Patent No.: US 10,325,455 B2
(45) Date of Patent: Jun. 18, 2019

(54) ALERTS PROVIDED BASED ON RESPONDER PROFILE

(71) Applicant: VMware, Inc., Palo Alto, CA (US)

(72) Inventor: Vardan Movsisyan, Yerevan (AM)

(73) Assignee: VMWARE, INC., Palo Alto, CA (US)

( * ) Notice: Subject to any disclaimer, the term of this patent is extended or adjusted under 35 U.S.C. 154(b) by 0 days.

(21) Appl. No.: 15/357,321

(22) Filed: Nov. 21, 2016

(65) Prior Publication Data

US 2018/0144588 A1 May 24, 2018

(51) Int. Cl.
*G08B 5/22* (2006.01)

(52) U.S. Cl.
CPC ..... *G08B 5/223* (2013.01); *G08B 5/22* (2013.01)

(58) Field of Classification Search
CPC .... G06Q 10/10; G06Q 10/107; G06Q 10/108; G06Q 20/401; G06Q 30/02; G08B 21/182; G08B 25/005; G08B 25/006; G08B 27/00; H04L 43/16; H04L 67/30; H04L 67/306; H04W 4/06; H04W 4/08; H04W 4/12; H04W 4/22; H04W 68/02
USPC ..... 340/539.11, 573.1
See application file for complete search history.

(56) References Cited

U.S. PATENT DOCUMENTS 5,848,396 A 12/1998 Gerace et al.
6,784,901 B1 * 8/2004 Harvey ..... H04L 12/1827 709/204
7,711,768 B1 * 5/2010 Hamilton ..... G06Q 10/10 370/229
2009/0271293 A1 * 10/2009 Parkhurst ..... G06Q 30/0601 705/26.1
2011/0029622 A1 2/2011 Walker et al.
2011/0119258 A1 * 5/2011 Forutanpour ..... G06Q 10/107 707/723
2011/0316723 A1 * 12/2011 Wohlert ..... G06Q 10/10 341/20
2013/0103493 A1 * 4/2013 Gao ..... G06Q 10/10 705/14.46
2013/0246098 A1 * 9/2013 Habboush ..... G06Q 10/10 705/3
2014/0310329 A1 * 10/2014 Jones ..... H04L 67/306 709/201
2014/0365471 A1 * 12/2014 Jaffer ..... G06Q 10/06 707/722
2016/0006681 A1 * 1/2016 Syre ..... H04L 51/26
2016/0019402 A1 * 1/2016 Khandelwal ..... H04L 67/306 726/26
2016/0094709 A1 * 3/2016 Bhattacharya ..... H04M 3/424 379/210.01
2016/0253368 A1 * 9/2016 Deolalikar ..... G06Q 10/107
2016/0371449 A1 * 12/2016 Brouse ..... H04W 4/22
2017/0034300 A1 * 2/2017 George ..... H04L 67/32
2017/0353529 A1 * 12/2017 Harpur ..... H04L 67/10

* cited by examiner

*Primary Examiner* — Quan-Zhen Wang
*Assistant Examiner* — Stephen R Burgdorf

(57) ABSTRACT

The present disclosure is related to devices, systems, and methods for alerts provided based on responder profile. An example device can include instructions to receive an alert message via an operations management server, access a plurality of alert responder profiles in storage, each associated with a respective alert responder and determined based on historical actions of the respective alert responder, and communicate the alert message to an alert responder having an alert responder profile that exceeds a threshold correlation with the alert message.

16 Claims, 3 Drawing Sheets

ALERTS PROVIDED BASED ON RESPONDER PROFILE

BACKGROUND

Alerts can communicate events that may call for human involvement. Alerts may be communicated to alert responders. Alert responders may be employed to view, respond to, and/or resolve alerts. In previous approaches, alerts may be communicated to alert responders as a matter of course, irrespective of the historical actions taken by each alert responder. For example, alerts may be communicated without consideration paid to the individual area(s) of expertise and/or the type(s) of alerts responders have responded to in the past. In addition, previous approaches may not communicate alerts via channel(s) of communication actually used by a given alert responder.

DETAILED DESCRIPTION

Figure 1:
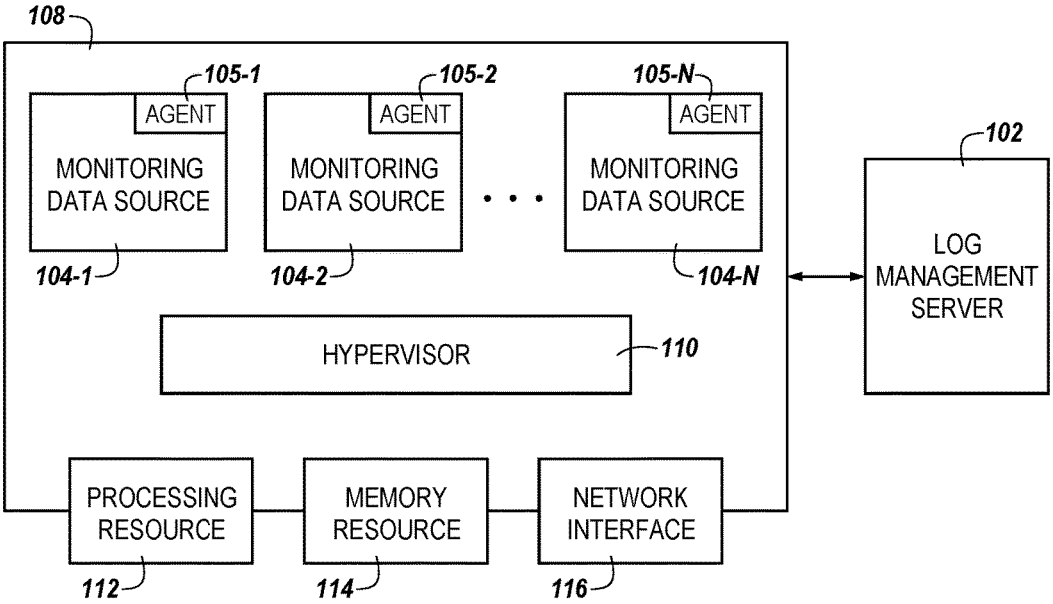
FIG. 1 is a diagram of an example of an infrastructure for alerts provided based on responder profile according to the present disclosure.

A monitoring data source, as used herein, refers to a source of monitoring data (e.g., event logs, status logs, metrics, etc.). In general, a monitoring data source can refer to any entity capable of generating logs and/or monitoring data. For instance, a monitoring data source can be a server (e.g., a physical server), a virtual computing instance, an application, a host, a network device, a desktop computing device, an event channel, a log aggregator, a log file, etc. A log management server and/or an operations management server (referred to herein as "management server") can configure and/or monitor logs and/or metrics reflecting status or configuration of one or more monitoring data sources.

Monitoring data can be collected from objects in an environment. Each piece of data collected can be called a metric observation or value. Metrics can include raw metrics. Metrics can include self-monitoring metrics. Metrics can include capacity metrics, badge metrics, and/or metrics to monitor the health of a computing system. Alerts can be generated for one or more log sources. The management server can receive, retrieve, store, and/or display alerts. In some embodiments, the management server can outsource one or more aspects of receiving, retrieving, storing, and/or displaying alerts to other entities. Where the example of "logs" is used herein, it is to be understood that embodiments of the present disclosure are not so limited.

Alert messages (sometimes referred to herein simply as "alerts") can be provided or communicated to users, referred to herein as an "alert responders," via an application interface. The application interface can be, for instance, an alert management component of an operations management platform and/or server. In some embodiments, the application interface can be implemented via a mobile device (e.g., smart phone, tablet, wearable device, personal digital assistant (PDA), etc.). Alerts can be communicated to users via channels such as email and/or short message service (SMS), for instance. When provided with an alert, an alert responder may attempt to respond to the alert (e.g., resolve the problem indicated by the alert). Responding to an alert, as referred to herein, includes accessing an alert interface (e.g., a webpage) and/or a communicated message (e.g., SMS) containing and/or indicating the alert.

However, previous approaches to providing alerts may be less efficient because they may not provide relevant alerts to appropriate alert responders. Accordingly, previous approaches may flood an alert responder with low-priority alerts, alerts outside of his individual area(s) of expertise, and/or alerts outside his scope of responsibility. The sheer amount of alerts may make it difficult for responders to sift through and find the alerts to which they are interested in, responsible for, and/or capable of, responding.

Embodiments of the present disclosure can track the actions of an alert responder with respect to alerts. In some embodiments, actions can be tracked from logs. In some embodiments, actions can be tracked by a monitoring service that tracks responder inputs. For example, the selection of a selectable element can be logged. A response to an alert can be logged. Types and/or groups of alerts responded to can be logged. Escalation levels of alerts responded to can be logged. Priority levels of alerts responded to can be logged. The log(s) can indicate which alert(s) the alert responder responded to, at what times, and at what frequency. Accordingly, embodiments herein can determine an alert responder profile for each alert responder based on the respective historical actions of the alert responders. From these actions, the alert responder profiles can include preferences, habits, qualifications, knowledge, and/or behaviors (herein referred to as "tendencies") particular to an alert responder. In addition, each alert responder profile can include communication channel(s) determined to be preferred by the alert responder based on historical evidence.

Based on the determined profiles, embodiments herein can communicate alerts to appropriate alert responders. Stated differently, embodiments herein can determine one or more aspects of an alert (e.g., a newly-received and/or reassigned alert), compare those aspects to the alert responder profiles, and communicate the alert to one or more alert responders having an alert responder profile that exceeds a threshold correlation with the alert. In addition, the communication of the alert can be made via a channel the alert responder has been found to actually use in responding to past alerts. Accordingly, alert responders can be provided with alerts tailored to them instead of bombarded with countless alerts, many of which are irrelevant and/or not applicable to them. In some embodiments, alerts can be prioritized and/or ordered according to their correlation with an alert responder profile. In some embodiments, alerts not having a threshold correlation with an alert responder profile may not be communicated at all to the associated alert responder.

As referred to herein, the term "monitoring data source" can refer to a virtual computing instance (VCI), which covers a range of computing functionality. VCIs may include non-virtualized physical hosts, virtual machines (VMs), and/or containers. A VM refers generally to an isolated end user space instance, which can be executed within a virtualized environment. Other technologies aside from hardware virtualization can provide isolated end user space instances may also be referred to as VCIs. The term "VCI" covers these examples and combinations of different types of VCIs, among others. VMs, in some embodiments, operate with their own guest operating systems on a host using resources of the host virtualized by virtualization software (e.g., a hypervisor, virtual machine monitor, etc.).

Multiple VCIs can be configured to be in communication with each other in a software defined data center. In such a system, information can be propagated from an end user to at least one of the VCIs in the system, between VCIs in the system, and/or between at least one of the VCIs in the system and a management server. In some embodiments, the management server can be provided as a VCI. Software defined data centers are dynamic in nature. For example, VCIs and/or various application services, may be created, used, moved, or destroyed within the software defined data center. When VCIs are created, various processes and/or services start running and consuming resources. As used herein, "resources" are physical or virtual components that have a finite availability within a computer or software defined data center. For example, resources include processing resources, memory resources, electrical power, and/or input/output resources.

The present disclosure is not limited to particular devices or methods, which may vary. The terminology used herein is for the purpose of describing particular embodiments, and is not intended to be limiting. As used herein, the singular forms "a", "an", and "the" include singular and plural referents unless the content clearly dictates otherwise. Furthermore, the words "can" and "may" are used throughout this application in a permissive sense (i.e., having the potential to, being able to), not in a mandatory sense (i.e., must). The term "include," and derivations thereof, mean "including, but not limited to."

The figures herein follow a numbering convention in which the first digit or digits correspond to the drawing figure number and the remaining digits identify an element or component in the drawing. Similar elements or components between different figures may be identified by the use of similar digits. For example, 112 may reference element "12" in FIG. 1, and a similar element may be referenced as 312 in FIG. 3. A group or plurality of similar elements or components may generally be referred to herein with a single element number. For example a plurality of reference elements 104-1, 104-2, . . . , 104-N may be referred to generally as 104. As will be appreciated, elements shown in the various embodiments herein can be added, exchanged, and/or eliminated so as to provide a number of additional embodiments of the present disclosure. In addition, as will be appreciated, the proportion and the relative scale of the elements provided in the figures are intended to illustrate certain embodiments of the present disclosure, and should not be taken in a limiting sense.

FIG. 1 is a diagram of an example of an infrastructure for alerts provided based on responder profile according to the present disclosure. For example, FIG. 1 can be a diagram of a host 108 for providing alerts based on responder profile according to the present disclosure. The host 108 can include processing resources 112 (e.g., a number of processors), memory resources 114, and/or a network interface 116. Memory resources 114 can include volatile and/or non-volatile memory. Volatile memory can include memory that depends upon power to store information, such as various types of dynamic random access memory (DRAM) among others. Non-volatile memory can include memory that does not depend upon power to store information. Examples of non-volatile memory can include solid state media such as flash memory, electrically erasable programmable read-only memory (EEPROM), phase change random access memory (PCRAM), magnetic memory, optical memory, and/or a solid state drive (SSD), etc., as well as other types of machine-readable media. For example, the memory resources 114 may comprise primary and/or secondary storage.

The host 108 can be included in a software defined data center. A software defined data center can extend virtualization concepts such as abstraction, pooling, and automation to data center resources and services to provide information technology as a service (ITaaS). In a software defined data center, infrastructure, such as networking, processing, and security, can be virtualized and delivered as a service. A software defined data center can include software defined networking and/or software defined storage. In some embodiments, components of a software defined data center can be provisioned, operated, and/or managed through an application programming interface (API).

The host 108 can incorporate a hypervisor 110 that can execute a number of VCIs 104-1, 104-2, . . . , 104-N that can each provide the functionality of a monitoring data source. As such, the VCIs may be referred to herein as "monitoring data sources." The monitoring data sources 104-1, 104-2, . . . , 104-N are referred to generally herein as "monitoring data sources 104." The monitoring data sources 104 can be provisioned with processing resources 112 and/or memory resources 114 and can communicate via the network interface 116. The processing resources 112 and the memory resources 114 provisioned to the servers 104 can be local and/or remote to the host 108. For example, in a software defined data center, the monitoring data sources 104 can be provisioned with resources that are generally available to the software defined data center and are not tied to any particular hardware device. By way of example, the memory resources 114 can include volatile and/or non-volatile memory available to the monitoring data sources 104. The monitoring data sources 104 can be moved to different hosts (not specifically illustrated), such that different hypervisors manage the monitoring data sources 104. In some embodiments, a monitoring data source among the number of monitoring data sources can be a master monitoring data source. For example, monitoring data sources 104-1 can be a master monitoring data sources, and monitoring data sources 104-2, . . . , 104-N can be slave monitoring data sources. In some embodiments, each monitoring data sources 104 can include a respective logging agent 105-1, 105-2, . . . , 105-N (referred to generally herein as logging agents 105) deployed thereon.

In some embodiments, each the monitoring data sources 104 can provide a same functionality. In some embodiments, one or more of the monitoring data sources 104 can provide a different functionality than another of the one or more monitoring data sources 104. For example, one or more of the monitoring data sources 104 can provide email functionality. In some embodiments, one or more of the monitoring data sources 104 are configured to selectively permit client login. In some embodiments, one or more of the monitoring data sources 104 are email monitoring data sources. In some embodiments, one or more of the monitoring data sources 104 are application monitoring data sources. In a number of embodiments, one or more of the monitoring data sources 104 can be servers, such as files servers, print servers, communication servers (such as email, remote access, firewall, etc.), application servers, database servers, web servers, and others. Embodiments herein are not intended to limit the monitoring data sources 104 to a particular type and/or functionality.

The monitoring data sources 104 can each record and/or maintain a respective event log (herein referred to as a "log") which tracks events (e.g., actions, and/or activities) taking place on the respective monitoring data source. The logs can be recorded in real time, for instance. In some embodiments, the logs can track aspects of a number of applications and/or programs. In some embodiments, the logs can track physical and/or virtual hardware usage.

Events in the logs can be accompanied by event information. Event information included in each of the logs can include, for instance, a timestamp of an event, a source of the event, including, for instance, a particular code path (e.g., com.vmware.loginsight.action1), UI (e.g., $loginsight-url/admin/#element1), text associated with the event, and/or a name-value pair extracted from the event. In some embodiments, logs can be received by the management server 102. In some embodiments, a client device (e.g., a computing device) can pull logs from the management server 102. In some embodiments, the management server 102 can push logs to a client device.

Figure 2:
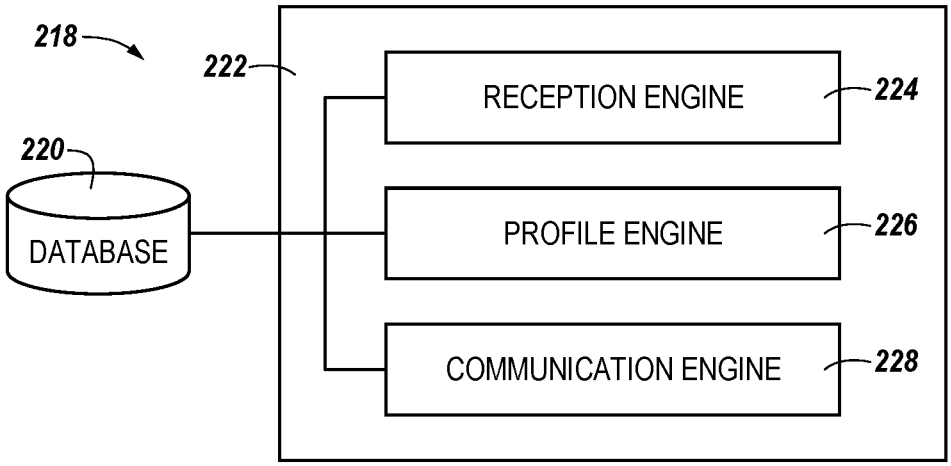
FIG. 2 is a diagram of a general logical system structure implementing alerts provided based on responder profile according to the present disclosure.

FIG. 2 is a diagram of a general logical system structure implementing alerts provided based on responder profile according to the present disclosure. For example, FIG. 2 can be a diagram of a system for alerts provided based on responder profile according to the present disclosure. The system shown in FIG. 2 can be implemented in a management server, for instance, such as the management server 102, previously discussed.

The system 218 can include a database 220, a subsystem 222, and/or a number of engines, for example a reception engine 224, a profile engine 226, and/or a communication engine 228, and can be in communication with the database 220 via a communication link. The system 218 can include additional or fewer engines than illustrated to perform the various functions described herein. The system 218 can represent program instructions and/or hardware of a machine (e.g., machine 330 as referenced in FIG. 3, etc.). As used herein, an "engine" can include program instructions and/or hardware, but at least includes hardware. Hardware is a physical component of a machine that enables it to perform a function. Examples of hardware can include a processing resource, a memory resource, a logic gate, etc.

The number of engines (e.g., 224, 226, 228) can include a combination of hardware and program instructions that are configured to perform a number of functions described herein. The program instructions (e.g., software, firmware, etc.) can be stored in a memory resource (e.g., machine-readable medium) as well as hard-wired program (e.g., logic). Hard-wired program instructions (e.g., logic) can be considered as both program instructions and hardware.

In some embodiments, the reception engine 224 can include a combination of hardware and program instructions that can be configured to receive an alert message via an operations management server. The alert can be referred to as a new alert instance, and can be received and/or retrieved. The alert can be obtained as a product of a workflow of the management server, for instance, and may be a portion of a workflow of a new alert construction process. In some embodiments, the alert may not be new but may have been previously assigned to a particular alert responder and become unassigned to that alert responder.

In some embodiments, the profile engine 226 can include a combination of hardware and program instructions that can be configured to access a plurality of alert responder profiles in storage, each associated with a respective alert responder and determined based on historical actions of the respective alert responder. As previously discussed, the historical alert responder actions can be determined based on a log associated with the operations management server, though embodiments herein are not so limited. Alert responder actions can be logged over a period of time and/or a number of alerts to which the alert responder responded. The duration of such a period is not intended to be limited herein, nor is it intended to be universally applicable. In some embodiments, actions can be tracked over a period of hours, days, months, years, etc. In some embodiments, actions can be tracked for a particular number of historical alerts. In some embodiments, actions can be tracked on a continual basis allowing for further refinement of responder profiles as their tendencies, job description, and/or knowledge change.

Actions can be made via an interface. The interface can include a display, such as an application interface and/or a web page, for instance. The interface can include an audio interface such as in a voice-controlled application. The interface can include selectable elements (e.g., selectable display elements and/or audio selectable elements). Display elements can be selected using one or more input devices, such as a touchscreen, mouse, keyboard, pointer, etc. Display elements refer to a selectable portion of a display, the selection of which causes an action to be performed with respect to the application. Examples of display elements include, but are not limited to, icons, buttons, tabs, lists, and menus. Audio selectable elements can be selected using recognized voice commands, for instance. It is noted, however, that embodiments herein do not limit selectable elements to a particular type, nor do embodiments herein limit the selection of elements to a particular manner using a particular device.

As previously discussed, each alert responder profile can be created based on historical alert responder actions with respect to historical alert messages received via the operations management server. In addition, and as discussed below, alert responder profiles can be determined based on job titles, job descriptions, and/or knowledge of alert responders. Historical actions can indicate tendencies. Tendencies can relate to types and/or groups of alerts responded to by the alert responder. Types of alerts refer to a classification of alerts and can include, for instance, email-server-related alerts, storage-related alerts, VCI-related alerts, etc. Groups of alerts can include, for instance, similarly-situated alerts and/or alerts sharing a common origin (e.g., alerts arising from a datacenter in Armenia). While one alert responder may tend to respond to email-server alerts, another may tend to respond to storage alerts, for instance.

An alert responder profile can include one or more communication channels used by the alert responder to respond to alerts and/or one or more communication channels not used by the alert responder to respond to alerts. In some embodiments, the alert responder profile can include one or more communication channels to which the alert responder reacts faster than others. In some cases, certain alert responders may tend to respond to alerts when they are provided by email, while other alert responders may tend to ignore alerts provided by email. It is noted that embodiments herein are not limited to particular communication channels through which to provide alerts. Alert responder profiles in accordance with embodiments of the present disclosure can include tendencies related to communication channels such as email and/or SMS, but are not limited thereto.

Tendencies can include escalation levels of alert messages responded to by the alert responder. Escalation level can refer to an organization level to which the alert has risen. For example, a first escalation level may refer to a "normal" level and a second escalation level may refer to an "escalated to management" level. Escalation levels may be assigned numerical identifiers (e.g., along a numerical scale indicating escalation level). Different alert responders may have their own tendencies with respect to responding to differing escalation levels. For example, a junior alert responder (e.g., admin) may respond to a more straightforward alert (e.g., an "easier" alert) while a senior alert responder may intervene when the alert is not solved and/or escalated to his level. In some embodiments, a senior alert responder may respond to an alert labeled "critical-alert" or "critical-infra-related-normal-alert," for instance.

Tendencies can include priority levels of alert messages responded to by the alert responder. Priority levels may include "error" and/or "critical," among others. An alert responder may tend to respond more to alerts that have been given a "critical" priority, for instance. Another alert responder may tend to respond more to alerts of lower priority.

In some embodiments, the communication engine 228 can include a combination of hardware and program instructions that can be configured to communicate the alert message to an alert responder having an alert responder profile that exceeds a threshold correlation with the alert message. Determining correlations between profiles and alerts can include determining correlations between types, escalation levels, priority levels, and/or other aspects of alerts with the associated tendencies indicated by the alert responder profiles.

In some embodiments, an alert responder profile of an alert responder can exceed a threshold correlation with an alert message when a type of the alert message and the types of alert messages responded to by the alert responder exceeds a type correlation threshold. In some embodiments, an alert responder profile of an alert responder can exceed a threshold correlation with an alert message when a group of the alert message and the groups of alert messages responded to by the alert responder exceeds a group correlation threshold. In some embodiments, an alert responder profile of an alert responder can exceed a threshold correlation with an alert message when an escalation level of the alert message and the escalation levels of alert messages responded to by the alert responder exceeds an escalation correlation threshold. In some embodiments, an alert responder profile of an alert responder can exceed a threshold correlation with an alert message when a priority level of the alert message and the priority levels of alert messages responded to by the alert responder exceeds a priority correlation threshold. In some embodiments, more than a single correlation may be needed to exceed the threshold correlation.

The communication engine 228 can include a combination of hardware and program instructions that can be configured to communicate the alert via the communication channel used by the alert responder to respond to alerts. The communication channel used by the alert responder to respond to alerts, as referred to herein, can include a communication channel used to receive the alert and not used to respond to that alert (e.g., a different channel is used to actually respond to the alert). For instance, a web user interface may be used to generally respond to alerts, but a particular user may tend to only use that web user interface to respond to alerts when those alerts were received via SMS. In that example, SMS may be referred to as the communication channel used by the alert responder to respond to alerts.

If, for example, an alert responder has a profile that is determined to exceed the threshold correlation with an alert, and if the profile indicates that the alert responder prefers responding to alerts provided via SMS, that alert can be communicated to the alert responder via SMS. In some embodiments, alerts can be communicated or not communicated to a particular alert responder based on detected and/or correlated client conditions (e.g., current network connectedness and/or bandwidth utilization of the alert responder's workstation). For example, an alert may be provided to an alert responder that is not isolated from the network by an antivirus and/or firewall functionality.

In some embodiments, different channels may be used for different alerts (e.g., different alert types, groups, escalation levels, priorities, etc.). In some embodiments, a more generalized approach may be taken in which a particular channel is used for alerts exceeding one or more of the type correlation, group correlation, escalation correlation, and/or priority correlation thresholds. In some embodiments, an even more generalized approach may be taken where a particular channel is used for all alerts.

Figure 3:
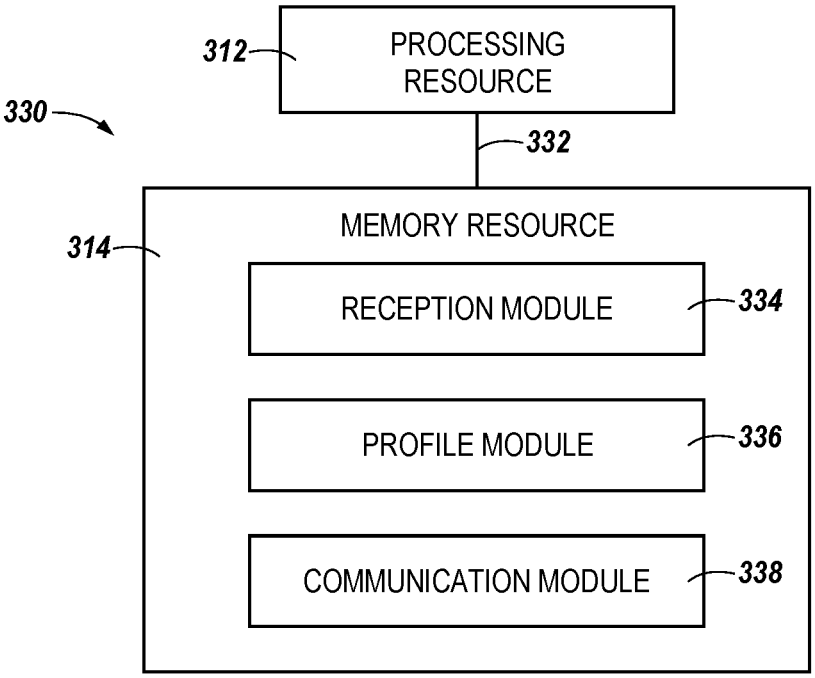
FIG. 3 is a diagram of an example system structure implementing alerts provided based on responder profile according to the present disclosure.

FIG. 3 is a diagram of an example system structure implementing alerts provided based on responder profile according to the present disclosure. For example, FIG. 3 can be a diagram of a machine for alerts provided based on responder profile according to the present disclosure. The machine 330 can utilize software, hardware, firmware, and/or logic to perform a number of functions. The machine 330 can be a combination of hardware and program instructions configured to perform a number of functions (e.g., actions). The hardware, for example, can include a number of processing resources 312 and a number of memory resources 314, such as a machine-readable medium (MRM) or other memory resources 314. The memory resources 314 can be internal and/or external to the machine 330 (e.g., the machine 330 can include internal memory resources and have access to external memory resources). The program instructions (e.g., machine-readable instructions (MM)) can include instructions stored on the MRM to implement a particular function (e.g., an action such as causing a plurality of alert messages to be displayed to a first alert responder in a first order based on a first alert responder profile). The set of MRI can be executable by one or more of the processing resources 312. The memory resources 314 can be coupled to the machine 330 in a wired and/or wireless manner. For example, the memory resources 314 can be an internal memory, a portable memory, a portable disk, and/or a memory associated with another resource, e.g., enabling MM to be transferred and/or executed across a network such as the Internet. As used herein, a "module" can include program instructions and/or hardware, but at least includes program instructions.

The memory resources 314 can be non-transitory and can include volatile and/or non-volatile memory. Volatile memory can include memory that depends upon power to store information, such as various types of dynamic random access memory (DRAM) among others. Non-volatile memory can include memory that does not depend upon power to store information. Examples of non-volatile memory can include solid state media such as flash memory, electrically erasable programmable read-only memory (EEPROM), phase change random access memory (PCRAM), magnetic memory, optical memory, and/or a solid state drive (SSD), etc., as well as other types of machine-readable media.

The processing resources 312 can be coupled to the memory resources 314 via a communication path 332. The communication path 332 can be local or remote to the machine 330. Examples of a local communication path 332 can include an electronic bus internal to a machine, where the memory resources 314 are in communication with the processing resources 312 via the electronic bus. Examples of such electronic buses can include Industry Standard Architecture (ISA), Peripheral Component Interconnect (PCI), Advanced Technology Attachment (ATA), Small Computer System Interface (SCSI), Universal Serial Bus (USB), among other types of electronic buses and variants thereof. The communication path 332 can be such that the memory resources 314 are remote from the processing resources 312, such as in a network connection between the memory resources 314 and the processing resources 312. That is, the communication path 332 can be a network connection. Examples of such a network connection can include a local area network (LAN), wide area network (WAN), personal area network (PAN), and the Internet, among others.

As shown in FIG. 3, the MRI stored in the memory resources 314 can be segmented into a number of modules 334, 336, 338 that when executed by the processing resources 312 can perform a number of functions. As used herein a module includes a set of instructions included to perform a particular task or action. The number of modules 334, 336, 338 can be sub-modules of other modules. For example, the communication module 338 can be a sub-module of the profile module 336 and/or can be contained within a single module. Furthermore, the number of modules 334, 336, 338 can comprise individual modules separate and distinct from one another. Examples are not limited to the specific modules 334, 336, 338 illustrated in FIG. 3.

Each of the number of modules 334, 336, 338 can include program instructions and/or a combination of hardware and program instructions that, when executed by a processing resource 312, can function as a corresponding engine as described with respect to FIG. 2. For example, the reception module 334 can include program instructions and/or a combination of hardware and program instructions that, when executed by a processing resource 312, can function as the reception engine 224, the profile module 336 can include program instructions and/or a combination of hardware and program instructions that, when executed by a processing resource 312, can function as the profile engine 226, and/or the communication module 338 can include program instructions and/or a combination of hardware and program instructions that, when executed by a processing resource 312, can function as the communication engine 228.

Figure 4:
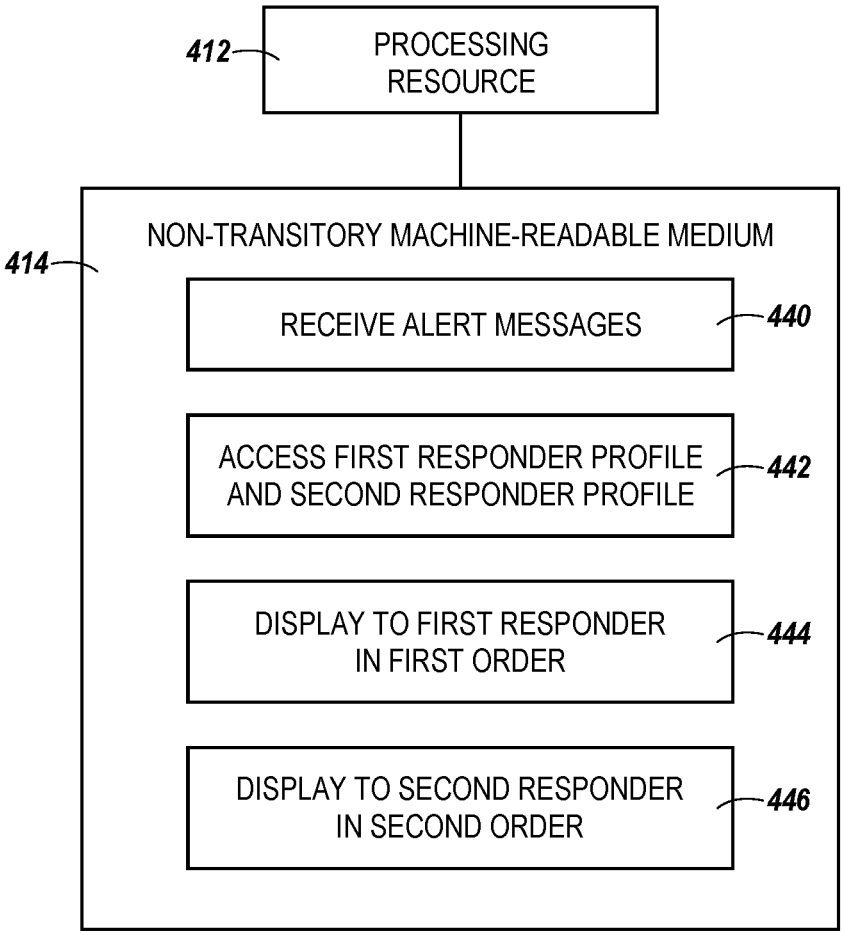
FIG. 4 illustrates a diagram of a non-transitory machine-readable medium for alerts provided based on responder profile according to the present disclosure.

FIG. 4 illustrates a diagram of a non-transitory machine-readable medium for alerts provided based on responder profile according to the present disclosure. The medium 414 can be part of a machine that includes a processing resource 412. The processing resource 412 can be configured to execute instructions stored on the non-transitory machine readable medium 414. For example, the non-transitory machine readable medium 414 can be any type of volatile or non-volatile memory or storage, such as random access memory (RAM), flash memory, read-only memory (ROM), storage volumes, a hard disk, or a combination thereof. When executed, the instructions can cause the processing resource 412 to provide alerts based on responder profile.

The medium 414 can store instructions 440 executable by the processing resource 412 to receive a plurality of alert messages via an operations management server. The medium 414 can store instructions 442 executable by the processing resource 412 to access a first alert responder profile associated with a first alert responder and a second alert responder profile associated with a second alert responder, wherein the first and second alert responder profiles are created based on historical alert messages responded to by the first alert responder and the second alert responder, respectively. As previously discussed, alerts can be displayed in an order and/or a prioritization according to their correlation with an alert responder profile. Accordingly, the medium 414 can store instructions 444 executable by the processing resource 412 to cause the plurality of alert messages to be displayed to the first alert responder in a first order based on the first alert responder profile, and the medium 414 can store instructions 446 executable by the processing resource 412 to cause the plurality of alert messages be displayed to the second alert responder in a second order based on the second alert responder profile.

In some embodiments, alerts can be displayed in different sizes. For instance, the first order can include a first subset of the plurality of alert messages displayed in a first size and a second subset of the plurality of alert messages displayed in a second size. Similarly, the second order can include the first subset of the plurality of alert messages displayed in the second size and the second subset of the plurality of alert messages displayed in the first size. Alternatively or additionally, different colors can be used to highlight particularly relevant (or less relevant) messages to alert responders.

Determining an alert responder profile and, consequently, which alert(s) to provide to the associated alert responder, can include determining a location of the alert responder and/or a time period the alert responder tends to respond to alerts. In an example where an alert may be equally relevant to two alert responders, priority can be given to one that is active (e.g., likely awake and/or available) when the alert is received. Accordingly, a particular portion of a day in which an alert message is received may, in part, determine which alert responder profiles best correlate with the alert. Alert messages not exceeding a threshold correlation may be hidden in some embodiments. Where reduction of noise is emphasized, for example, alerts may not be provided at all to those alert responders having profiles that do not exceed the threshold correlation.

Methods for alerts provided based on responder profile can include receiving resolutions to a plurality of alert messages over a period of time, the resolutions provided by an alert responder and determining alert information for each resolved alert message. The alert information can include, for example, a type of the alert message, an escalation level of the alert message, a priority level of the alert message, and a communication channel used by the alert responder to resolve the alert message. Methods can further include creating an alert responder profile for the alert responder including the alert information for each resolved alert message, in a manner analogous to that previously discussed. Thereafter, methods can include receiving a new alert message, comparing a content of the new alert message with the alert responder profile, and providing the alert message to the alert responder responsive to a determination that the comparison of the content of the new alert message with the alert responder profile exceeds a threshold.

In some embodiments, comparing the content of the new alert message with the alert responder profile can include performing a search (e.g., a key word search) of a body of text of the new alert. The body of text can include a header, title, and/or content of the alert. In some embodiments, the new alert message can be communicated to an archive location if an escalation level of the new alert message is below an escalation threshold.

In some embodiments, alert messages that were not resolved (e.g., ignored) by an alert responder may be used in determining the alert responder profile for that alert responder. Accordingly, methods in accordance with embodiments herein can include determining alert information for each of a plurality of alert messages not resolved by the alert responder, including a type of the alert message, an escalation level of the alert message, a priority level of the alert message, and a communication channel used to communicate the alert message to the alert responder. The alert responder profile can be created, in part including the alert information for each of the plurality of alert messages not resolved by the alert responder. When a new alert message is received, its content can be compared with the alert responder profile. The new alert message may not be provided to the alert responder responsive to a determination that the comparison of the content of the new alert message with the alert responder profile exceeds a threshold.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Various advantages of the present disclosure have been described herein, but embodiments may provide some, all, or none of such advantages, or may provide other advantages.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A non-transitory machine-readable medium having instructions stored thereon executable by a processor to:

receive an alert message via an operations management server, the alert message associated with a monitoring data source configured by the operations management server;

access a plurality of alert responder profiles in storage, each associated with a respective alert responder and determined based on historical actions of the respective alert responder, wherein each of the plurality of alert responder profiles includes:

a first communication channel historically used by the respective alert responder to respond to past alerts received by the respective alert responder; and a second communication channel historically not used by the respective alert responder to respond to past alerts received by the respective alert responder; and alert information for each of a plurality of alert messages received by the respective alert responder and not resolved by the respective alert responder; and communicate the alert message to an alert responder having an alert responder profile that exceeds a threshold correlation with the alert message via the first communication channel historically used by the alert responder to respond to past alerts received by the alert responder if a determination that a comparison of the alert message and the alert information for the plurality of alert messages received by the alert responder and not resolved by the alert responder does not exceed a threshold.

2. The medium of claim 1, including instructions to create each alert responder profile based on historical alert responder actions with respect to historical alert messages received via the operations management server.

3. The medium of claim 2, including instructions to determine the historical alert responder actions based on a log associated with the operations management server.

4. The medium of claim 1, including instructions to include in each alert responder profile:

types of alert messages responded to by the respective alert responder;

groups of alert messages responded to by the respective alert responder;

escalation levels of alert messages responded to by the respective alert responder; and priority levels of alert messages responded to by the respective alert responder.

5. The medium of claim 4, including instructions defining the threshold correlation with the alert message as being exceeded when any of:

a type of the alert message and the types of alert messages responded to by the respective alert responder exceeds a type correlation threshold;

a group of the alert message and the groups of alert messages responded to by the respective alert responder exceeds a group correlation threshold;

an escalation level of the alert message and the escalation levels of alert messages responded to by the respective alert responder exceeds an escalation correlation threshold; or a priority level of the alert message and the priority levels of alert messages responded to by the respective alert responder exceeds a priority correlation threshold.

6. A system, comprising:

a processing resource; and a memory resource configured to store instructions which, when executed by the processing resource, cause the processing resource to:

receive a plurality of alert messages via an operations management server, the alert messages associated with a monitoring data source configured by the operations management server;

access a first alert responder profile associated with a first alert responder and a second alert responder profile associated with a second alert responder, wherein the first and second alert responder profiles are created based on historical alert messages responded to by the first alert responder and the second alert responder, respectively, and wherein each of the first and second alert responder profiles includes:

a communication channel historically used by the respective alert responder to respond to received alerts; and a communication channel historically not used by the respective alert responder to respond to received alerts;

cause the plurality of alert messages to be displayed to the first alert responder in a first order via the communication channel historically used by the first alert responder to respond to alerts based on the first alert responder profile;

cause the plurality of alert messages be displayed to the second alert responder via the communication channel historically used by the second alert responder to respond to alerts in a second order based on the second alert responder profile; and hide a subset of the plurality of alert messages from one of the first alert responder and the second alert responder responsive to a determination that the one of the first alert responder and the second alert responder has a likelihood of responding to the subset of the plurality of alert messages that does not exceed a threshold.

7. The system of claim 6, wherein the first order includes a first subset of the plurality of alert messages displayed in a first size and a second subset of the plurality of alert messages displayed in a second size, and wherein the second order includes the first subset of the plurality of alert messages displayed in the second size and the second subset of the plurality of alert messages displayed in the first size.

8. The system of claim 6, wherein the first order and the second order include different ones of the plurality of alert messages displayed in different colors.

9. The system of claim 6, including instructions to:

cause the plurality of alert messages to be displayed to the first alert responder in the first order using a first mobile device; and cause the plurality of alert messages to be displayed to the second alert responder in the second order using a second mobile device.

10. The system of claim 6, including instructions to determine respective tendencies associated with the first alert responder and the second alert responder, wherein the tendencies include tendencies to respond to:

a particular type of alert message; and an alert message received in a particular portion of a day.

11. The system of claim 6, including instructions to determine the first order and the second order based, at least in part, on a job description of the first alert responder and the second alert responder, respectively.

12. The system of claim 11, wherein the respective job descriptions of the first alert responder and the second alert responder correspond to alert message types.

13. A method for providing alert messages, comprising:

receiving resolutions to a plurality of alert messages over a period of time, the resolutions provided by an alert responder, wherein each of the plurality of alert messages is associated with a monitoring data source configured by the operations management server;

determining alert information for each resolved alert message, including:

a type of the resolved alert message;

an escalation level of the resolved alert message;

a priority level of the resolved alert message;

a communication channel determined to have been used by the alert responder to resolve the resolved alert message; and a communication channel determined not to have been used by the alert responder to resolve the resolved alert message;

determining alert information for each of a plurality of alert messages not resolved by the alert responder, including:

a type of the alert message not resolved by the alert responder;

an escalation level of the alert message not resolved by the alert responder;

a priority level of the alert message not resolved by the alert responder; and a communication channel used to communicate the alert message not resolved by the alert responder to the alert responder;

creating an alert responder profile for the alert responder including the alert information for each resolved alert message and the alert information for each of the plurality of alert messages not resolved by the alert responder;

receiving a new alert message;

comparing a content of the new alert message with the alert responder profile; and providing the new alert message to the alert responder via the communication channel used by the alert responder to resolve at least one of the plurality of the resolved alert messages responsive to a determination that the comparison of the content of the new alert message with the alert responder profile exceeds a threshold if a determination that a comparison of the content of the new alert message with the alert information for the plurality of alert messages not resolved by the alert responder does not exceed a threshold.

14. The method of claim 13, wherein the method includes communicating the new alert message to an archive location if an escalation level of the new alert message is below a threshold.

15. The method of claim 13, wherein comparing the content of the new alert message with the alert responder profile includes performing a key word search of a title of the new alert message.

16. The method of claim 13, wherein comparing the content of the new alert message with the alert responder profile includes performing a key word search of a body of text of the new alert message.

* * * * *